US007862298B2

(12) United States Patent
Cvjeticanin et al.

(10) Patent No.: US 7,862,298 B2
(45) Date of Patent: Jan. 4, 2011

(54) CENTRIFUGAL COMPRESSOR HOUSING

(75) Inventors: Nenad Cvjeticanin, Frankfurt am Main (DE); Stephan Senftleben, Ronneburg (DE)

(73) Assignee: WOCO Industrietechnik GmbH, Bad Soden-Salmünster (DE)

( * ) Notice: Subject to any disclaimer, the term of this patent is extended or adjusted under 35 U.S.C. 154(b) by 657 days.

(21) Appl. No.: 11/679,788

(22) Filed: Feb. 27, 2007

(65) Prior Publication Data

US 2007/0199727 A1 Aug. 30, 2007

(30) Foreign Application Priority Data

Feb. 27, 2006 (DE) ..... 10 2006 009 054

(51) Int. Cl.
*F04D 29/40* (2006.01)

(52) U.S. Cl. ..... 415/215.1; 415/224.5

(58) Field of Classification Search ..... 415/213.1, 415/215.1, 204, 206, 224.5
See application file for complete search history.

(56) References Cited

U.S. PATENT DOCUMENTS

| | | | |
|---|---|---|---|
| 1,467,254 | A | 9/1923 | Tarbet |
| 3,429,605 | A | 2/1969 | Soesbergen |
| 4,867,641 | A | 9/1989 | Okuno |
| 5,209,461 | A | 5/1993 | Whightsil, Sr. |
| 5,219,461 | A | 6/1993 | Hyll |
| 5,257,904 | A | 11/1993 | Sullivan |
| 5,711,652 | A | 1/1998 | van de Venne |
| 5,989,664 | A | 11/1999 | Takayama et al. |
| 6,193,463 | B1 | 2/2001 | Adeff |
| 6,428,288 | B1 | 8/2002 | King |
| 6,652,222 | B1 | 11/2003 | Wojtyczka |
| 7,086,833 | B2 | 8/2006 | Cvjeticanin |
| 2004/0223847 | A1 * | 11/2004 | Cvjeticanin et al. ..... 415/206 |
| 2006/0201135 | A1 | 9/2006 | Xie |
| 2007/0020084 | A1 | 1/2007 | Krines |

(Continued)

FOREIGN PATENT DOCUMENTS

DE 27 06 110 A1 8/1978

(Continued)

OTHER PUBLICATIONS

European Search Report dated Dec. 6, 2007, in European Application No. EP 07004322, filed Mar. 2, 2007, 2 pages.

(Continued)

*Primary Examiner*—Edward Look
*Assistant Examiner*—Dwayne J White
(74) *Attorney, Agent, or Firm*—Christensen O'Connor Johnson Kindness PLLC

(57) ABSTRACT

A housing for a radial flow compressor, particularly for a turbocharger, comprises a first housing part and a second housing part joined together to form at least part of the housing, each of the housing parts comprising at least one cavity, said cavities in fluid communication, when the housing parts are juxtaposed, forming a cavity system into which a fluid joining compound, such as an adhesive, thermoplastic material, etc., is introduced to form a solid joint of said both housing parts, wherein the housing parts are dimensioned such that a gap for introducing the fluid joining compound extends from a free housing surface of the housing parts when juxtaposed, along facing joining surface sections of the housing parts, and ports into the cavity system.

21 Claims, 2 Drawing Sheets

U.S. PATENT DOCUMENTS

| | | | |
|---|---|---|---|
| 2007/0081887 | A1 | 4/2007 | Xie |
| 2008/0304960 | A1 | 12/2008 | Cvjeticanin |
| 2009/0053051 | A1 | 2/2009 | Cvjeticanin |
| 2009/0202379 | A1 | 8/2009 | Werner |

FOREIGN PATENT DOCUMENTS

| | | | |
|---|---|---|---|
| DE | 34 24 661 | A1 | 1/1986 |
| DE | 91 01 683 | U1 | 7/1992 |
| DE | 44 38 750 | A1 | 5/1996 |
| DE | 197 20 286 | A1 | 11/1998 |
| DE | 197 50 516 | A1 | 5/1999 |
| DE | 100 54 855 | A1 | 5/2002 |
| DE | 101 12 764 | A1 | 9/2002 |
| DE | 102 60 042 | A1 | 7/2004 |
| DE | 103 14 209 | B3 | 12/2004 |
| DE | 10314209 | B3 | 12/2004 |
| DE | 10 2004 041 439 | A1 | 3/2006 |
| DE | 20 2004 019 366 | U1 | 5/2006 |
| DE | 10 2005 055 200 | A1 | 5/2007 |
| DE | 10 2006 010 461 | B3 | 10/2007 |
| DE | 10 2007 009 781 | A1 | 8/2008 |
| DE | 10 2007 027 282 | B3 | 11/2008 |
| DE | 10 2007 054 899 | A1 | 5/2009 |
| DE | 10 2008 008 981 | A1 | 8/2009 |
| EP | 0 166 940 | B1 | 1/1986 |
| EP | 0 499 191 | A1 | 8/1992 |
| EP | 1 188 544 | A2 | 3/2002 |
| EP | 1 674 671 | A2 | 6/2006 |
| EP | 1 830 071 | A2 | 9/2007 |
| EP | 2 003 343 | A2 | 12/2008 |
| GB | 2 281 941 | A | 8/2010 |
| JP | 55-118845 | A | 9/1980 |
| JP | 58-056821 | A | 4/1983 |
| JP | 2000-205192 | A | 7/2000 |
| JP | 55-118844 | A | 8/2010 |
| WO | 97/10439 | A1 | 3/1997 |
| WO | 99/64747 | A1 | 12/1999 |

OTHER PUBLICATIONS

European Search Report dated Apr. 22, 2009, in European Application No. EP 08 010 316, filed Jun. 6, 2008, 2 pages.

Hunold, D. et al., "Ingeniuosly Combined - Profitably Manufactured: Multi-Component Injection Moulding of Thermoplastics and Thermosets,", Injection Moulding 91(3):39-41, Mar. 2001.

* cited by examiner

CENTRIFUGAL COMPRESSOR HOUSING

BACKGROUND

The present application relates to a housing for a centrifugal or radial flow compressor, for example a turbocharger, comprising a first housing part and a second housing part joined together to form at least part of the housing. For securing the housing parts to each other, a cavity is formed in each housing part. Together the cavities form, in a predetermined juxtaposed location of the housing parts, a cavity system, the cavities of the housing parts being in fluid communication with each other. To secure the housing parts, after being joined together, a fluid joining compound such as an adhesive, thermoplastics material, etc., is introduced into the cavity system. Due to the fluid action of the plastics material, the cavity system is completely filled. After a brief reaction, the plastics material hardens to form a solid, rigid joint between the housing parts.

A housing made in this way for a radial flow compressor having a proven record of success because of its high strength is known from DE 103 14 209 B3, featuring an input and an output in one of the housing parts for injecting the fluid joining compound and for compensating the air pressure respectively. Via the input, the fluid joining compound is injected to fill the cavity system, whereas the expelled air is able to escape via the output.

What is needed is a housing for a radial flow compressor, the manufacture of which, using the known method of joining housing parts by filling a cavity system with a fluid curing joining compound, is simplified.

SUMMARY

The following summary is provided to introduce various concepts in a simplified form that are further described below in the Detailed Description. This summary is not intended to identify specific key features of the claimed subject matter.

Described herein is a housing for a radial flow or centrifugal compressor, an example of which is a turbocharger. The housing is comprised of housing parts that have a gap for introducing fluid joining compound when the housing parts are juxtaposed along facing joining surfaces. The housing parts are dimensioned such that the gap extends from a free housing surface of the housing parts and ports into a cavity system. It has been surprisingly discovered that providing a channel for introducing the fluid joining compound by means of the gap at the joining surface now eliminates the complicated working steps of producing inputs and channels in a housing part. Additionally, the channel formed by the gap now creates an additional joining volume between the housing parts, as a result of which a highly reliable joint is now achieved between the housing parts.

Preferably, the first housing part and the second housing part define a compressor channel of the radial flow compressor. As a result, the first housing part may form a radial outer portion of the compressor channel and the second housing part may form a radial inner portion of the compressor channel, said inner portion being insertable into said outer portion in loose juxtaposition. The first housing part may form an inlet portion for an air intake port, while the second housing part may define a transition of the air intake port that opens out to the compressor channel.

In one preferred embodiment, the gap runs on a circular track, particularly in a circumferential plane, around the axis of the air intake port, achieving a homogenous solid joining structure of the housing formed by the two housing parts. In particular, the gap may concentrically surround the axis of the air intake port.

In another embodiment, the gap runs essentially radially from the free surface of the housing and preferably translates from a radial run into an axial section that ports into the cavity system.

In this arrangement, the cavity system is essentially radially oriented. The cavity system may be configured as a labyrinth structure having at least one passage. A particularly simple, but nevertheless sufficiently rugged and solid joining structure is formed using a cavity system comprising two radial recesses in the housing parts. The fluid joining compound introduced via the gap collects in the recesses until completely full therewith.

Preferably the gap extends radially outward from a free (inner) surface of the air intake port. The radial inner surface of the air intake port is thus suitable for positioning a entry portion adjacent to the gap for introducing the joining compound. It is here where free access is available for locating and placing corresponding means for pouring or introducing the joining compound in the gap. In one embodiment, the joining compound is injected into the gap.

To ensure proper positioning of the second housing part to the first housing part, each of the joining surfaces of the housing part form, in addition to the joint surface sections forming the gap, flange surface sections likewise each facing the other. When the housing parts are juxtaposed, the flange surface sections touch each other, while the joint surface sections forming the gap face each other without touching. In this arrangement the housing parts are manufactured such that the gap is formed without additional machining of the housing parts once the housing parts have assumed the position as located by the flange surface sections.

In another preferred embodiment, a seal is arranged in the region of the jointing surfaces at a side of the cavity system facing away from the gap. The seal may be in particular a sealing paste as may be arranged in the region of an axial joining flange portion connecting the radial gap to a radial section surface of the joining surfaces. For the seal, a recess may be provided in which the recess is formed at least by one of the housing parts and in which in particular an O-ring can be inserted.

Preferably, the seal is designed to prevent air leakage from the compressor channel to the output port, but to allow air to pass the seal when the joining compound is introduced via the gap to the cavity structure. However, the seal should hamper any flow-by of the joining compound beyond the location of the seal.

The invention also relates to a centrifugal or radial flow compressor, for example a turbocharger, comprising a housing as described herein.

DESCRIPTION OF THE DRAWINGS

Further advantages, properties and features of the invention will now be detailed by way of a preferred embodiment with reference to the enclosed drawings in which.

DETAILED DESCRIPTION

Figure 1:
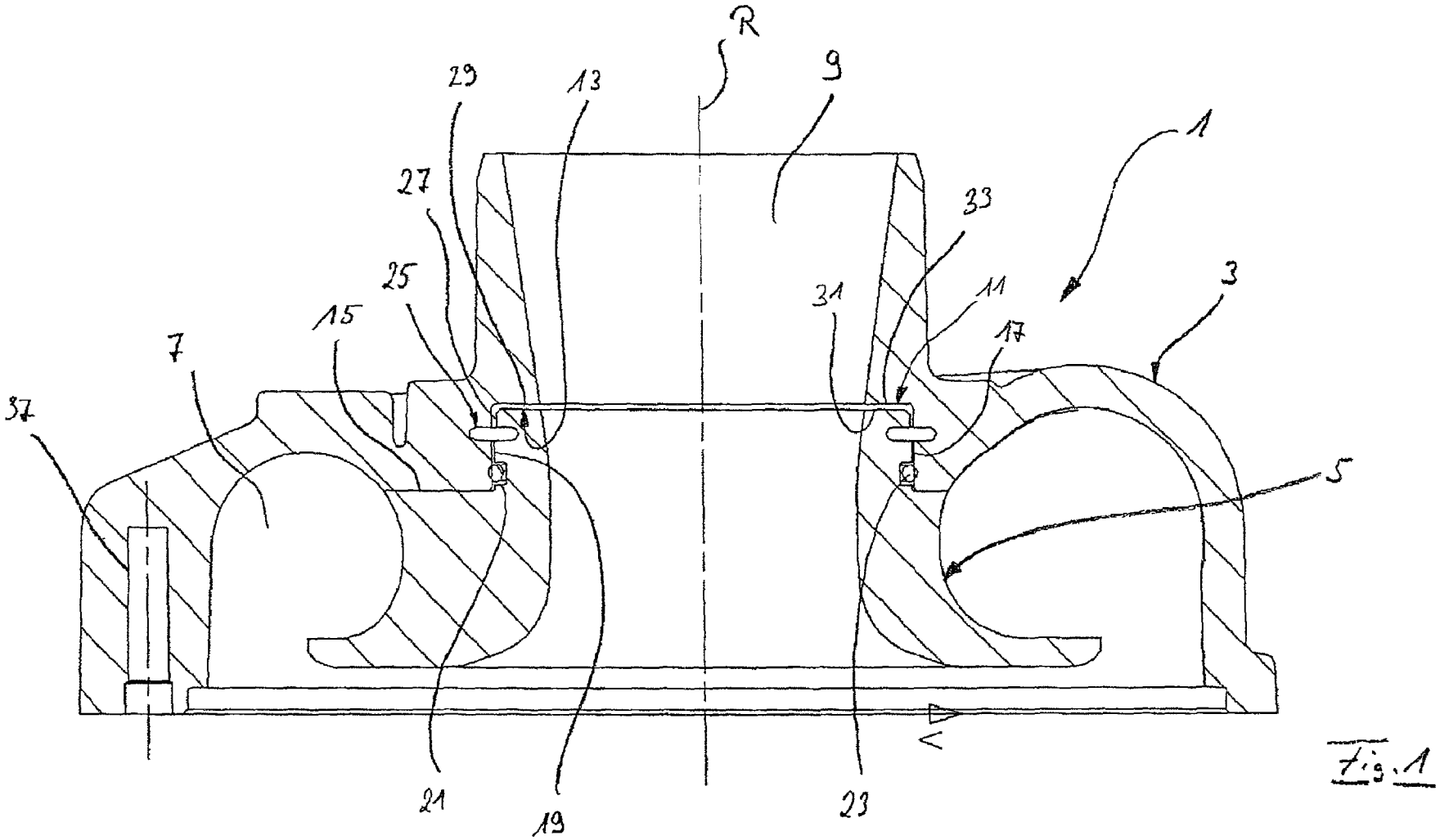
FIG. 1 is a cross-sectional view of one part of a turbocharger housing in accordance with the invention.
Figure 2:
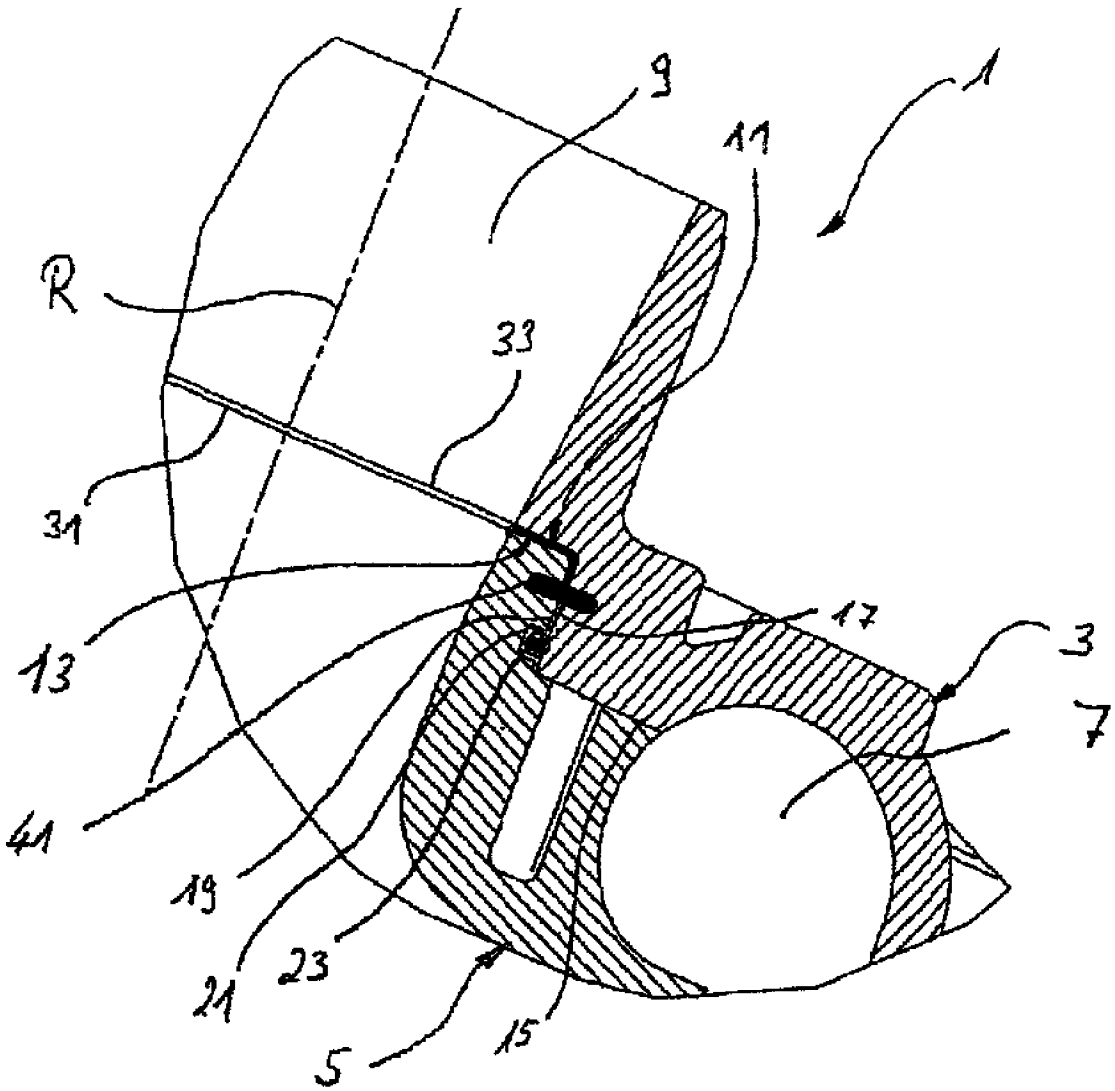
FIG. 2 is a detailed section view of the turbocharger housing in accordance with the invention taken along a section plane other than that of FIG. 1.

Referring now to FIGS. 1 and 2, there is partially illustrated a turbocharger housing identified by reference numeral 1. The housing has two housing parts 3, 5 although the housing could also be fabricated in more than two parts. The housing part 3 forms an outer shell of the turbocharger housing and defines radial outwardly a compressor channel 7 as well as at an input end an air intake port 9. The second housing part 5 forms partly an inner portion of the housing 1 and defines substantially radially inwardly the compressor channel 7 as well as the air intake port 9 in the transition to the compressor channel 7.

Each of the housing parts 3 and 5 has a joining surface 11, 13 substantially complementary in shape extending concentrically about the axis of rotation R of the housing 1. The joining surfaces 11, 13 extend from the inner side of the air intake port 9 z-wise radially outwards and port into the free surface area of the compressor channel 7.

On the outer side, the joining surfaces 11, 13 each comprise radially a flange surface section 15. The flange surface sections 15 are juxtaposed in the assembled condition of the housing parts 3, 5 to ensure that the housing part 3, 5 are properly positioned relative to each other.

Adjoining each flange surface section 15 and extending radial inwards from the free surface of the compressor channel 7 is an axial joining surface portion 17, 19 at which a recess 21 is configured near to the flange surface section 15 seating an O-ring 23.

Adjoining a side of the recess 21 facing away from the flange surface sections 15 is a cavity system 25 which in the embodiment shown in FIGS. 1 and 2 is formed by two radial deep grooves facing each other. Porting into the cavity system 25 is an axial gap section 27 adjoined by a longer radial gap section 29 porting into the free surface of the air intake port 9. Both the axial and the radial gap section 27, 29 are formed by facing joining surface sections 31, 33 which, in the assembled condition of the housing parts 3, 5 as shown in FIGS. 1 and 2, face each other without contact, thus defining a gap via which a fluid joining compound 41 can be introduced into the cavity system 25. The fluid joining compound 41 may be injected into the gap or otherwise introduced into the cavity system 25 by way of pouring, depositing, etc., the fluid jointing compound in the gap.

Referring now to FIG. 2, there is illustrated the housing 1 in a finished condition in which the cavity system 25 is filled via the gap with the fluid joining compound 41 now hardened, thus reliably joining the housing parts 3 and 5. The gap defined by the joining surface sections 31, 33 may have a cross-section of 0.5 mm to several mm which may be constant or vary to the cavity system 25.

Once the housing parts 3, 5 have been juxtaposed with the flange surface sections 15 juxtaposed, an injection tool (not shown) can be applied into the air intake port 9 in the region of the gap and a fluid joining compound 41 can be injected via the gap into the cavity system 25. The O-ring seal is designed to allow the air expelled on injection of the fluid joining compound 41 to pass while hampering flow-by thereof of the joining compound past the O-ring.

The rigid housing structure produced in this way following hardening of the fluid joining compound can be secured to a further housing part of the turbocharger or engine part (not shown) by a bolt fastener 37 so that the turbocharger can be fitted in the region of the intake tract of a motor vehicle.

The features as disclosed in the above description, figures and the subsequent claims may be of significance both singly and in any combination in realizing the invention in its various embodiments.

LIST OF REFERENCE NUMERALS

| | |
|---|---|
| 1 | housing |
| 3, 5 | housing parts |
| 7 | compressor channel |
| 9 | air intake port |
| 11, 13 | joining surface |
| 15 | flange surface section |
| 17, 19 | joining surface portions |
| 21 | recess |
| 23 | O-ring |
| 25 | cavity system |
| 27, 29 | gap section |
| 31, 33 | joining surface sections |
| 37 | bolt fastener |
| 41 | joining compound |
| R | axis of rotation |

The embodiments of the invention in which an exclusive property or privilege is claimed are defined as follows:

1. A housing for a radial flow compressor comprising a first housing part and a second housing part joined together along facing joining surfaces to form at least part of the housing, wherein when the first and second housing parts are juxtaposed, sections of the facing joining surfaces form at least one cavity, in fluid communication, and provide a cavity system into which a fluid joining compound is introduced to form a solid joint of said both housing parts, wherein the housing parts are dimensioned such that a gap, that is exclusively formed by the facing joining surface sections of the housing parts and used for introducing the fluid joining compound, extends from a free housing surface of the housing parts, along the facing joining surfaces of the housing parts, and ports into the cavity system.

2. The housing as set forth in claim 1, wherein the first housing part and second housing part define a compressor channel of the radial flow compressor.

3. The housing as set forth in claim 2, wherein the first housing part forms a radial outer portion of the compressor channel and the second housing part forms a radial inner portion of the compressor channel for insertion into the outer portion.

4. The housing as set forth in claim 2, wherein the first housing part forms an inlet of an air intake port, and the second housing part forms a transition of the air intake port porting into the compressor channel.

5. The housing as set forth in claim 4, wherein the gap surrounds the axis of the air intake port.

6. The housing as set forth in claim 5, wherein the gap concentrically surrounds the axis of the air intake port.

7. The housing as set forth in claim 1, wherein the gap extends radially from the free housing surface and translates into an axial section porting into the cavity system which is oriented radially.

8. The housing as set forth in claim 4, wherein the gap extends from a free housing surface of the air intake port.

9. The housing as set forth in claim 1, wherein the joining surfaces of the housing parts, except the joining surface sections forming the gap, each form a flange surface section, said flange surface sections being juxtaposed when the housing parts are juxtaposed.

10. The housing as set forth in claim 9, wherein the flange surface sections extend radially.

11. The housing as set forth in claim 9, wherein the joining surface sections forming the gap and the flange surface sections interface via an axial joining surface portion at which the cavity system is configured.

12. The housing as set forth in claim 1, wherein a seal is arranged in a region of the joining surfaces on a side of the cavity system facing away from the gap.

13. The housing as set forth in claim 12, wherein the seal is arranged in the region of an axial joining surface portion.

14. The housing as set forth in claim 12, wherein for the seal a recess is provided formed at least by one of the housing parts.

15. The housing as set forth in claim 14, wherein the seal is an O-ring inserted into the recess.

16. The housing as set forth in claim 12, wherein the seal is configured to hamper passage of the fluid joining compound but permit blow-by of air when the fluid joining compound is introduced into the gap.

17. The housing as set forth in claim 1, wherein the radial flow compressor is a turbocharger.

18. A centrifugal compressor having a housing comprising a first housing part and a second housing part that, when joined together along facing joining surfaces, form at least part of the housing, wherein when the first and second housing parts are juxtaposed, sections of the facing joining surfaces form at least one cavity in fluid communication and provide a cavity system into which a fluid joining compound can be introduced to form a solid joint of said both housing parts, wherein the housing parts are dimensioned such that a gap formed exclusively by the facing joining surface sections and used for introducing the fluid joining compound extends from a free housing surface of the housing parts, along the facing joining surfaces of the housing parts, and ports into the cavity system.

19. The centrifugal compressor as set forth in claim 18, wherein the centrifugal compressor is a turbocharger.

20. The centrifugal compressor as set forth in claim 18, wherein the joining surfaces of the housing parts, except the joining surface sections forming the gap, each form a flange surface section, said flange surface sections being juxtaposed when the housing parts are juxtaposed, and wherein the joining surface sections forming the gap and the flange surface sections interface via an axial joining surface portion at which the cavity system is configured.

21. A housing for a radial flow compressor comprising:

a first housing part; and a second housing part that is joined together with the first housing part along facing joining surfaces to form at least part of the housing, wherein when the first and second housing parts are juxtaposed, sections of the facing joining surfaces of the first and second housing parts form at least one cavity in fluid communication and provide a cavity system into which a fluid joining compound is introduced to form a solid joint of the first and second housing parts, wherein the facing joining surfaces of the housing parts are dimensioned to form a gap for introducing the fluid joining compound, said gap extending from a free housing surface of the housing parts when juxtaposed, along the facing joining surfaces of the housing parts, into the cavity system, and wherein a seal is arranged in a region of the facing joining surfaces of the housing parts on a side of the cavity system facing away from the gap.

* * * * *

UNITED STATES PATENT AND TRADEMARK OFFICE

CERTIFICATE OF CORRECTION

PATENT NO. : 7,862,298 B2
APPLICATION NO. : 11/679788
DATED : January 4, 2011
INVENTOR(S) : N. Cvjeticanin et al.

It is certified that error appears in the above-identified patent and that said Letters Patent is hereby corrected as shown below:

On the title page, item:

| | | |
|---|---|---|
| (56) Pg. 2, col. 1 | Refs. Cited (Foreign Patent Documents, Item 9) | Delete the second occurrence of "DE 10314209 B3 12/2004" |
| (56) Pg. 2, col. 2 | Refs. Cited (Other Publs., Item 2) | "HUNOLD, D." should read --HUNOLD, D.,-- |
| (56) Pg. 2, col. 2 | Refs. Cited (Other Publs., Item 2) | "Thermosets,"," should read --Thermosets,-- |

| COLUMN | LINE | |
|---|---|---|
| 2 | 18 | "a entry" should read --an entry-- |
| 2 | 36 | "jointing" should read --joining-- |
| 3 | 23 | "radial" should read --radially-- |
| 3 | 41 | "jointing" should read --joining-- |
| 4 (Claim 1, line 6) | 26 | "cavity, in fluid communication, and" should read --cavity in fluid communication and-- |

Signed and Sealed this
Twenty-sixth Day of July, 2011

David J. Kappos

David J. Kappos
*Director of the United States Patent and Trademark Office*

| COLUMN | LINE | |
|---|---|---|
| 4 (Claim 1, line 12) | 32 | After "housing parts" delete "," |
| 5 (Claim 18, line 12) | 29 | After "housing parts" delete "," |